US005855281A

United States Patent [19]

Rabas

[11] Patent Number: 5,855,281

[45] Date of Patent: Jan. 5, 1999

[54] PRODUCT DISPLAY SYSTEM

[75] Inventor: Kenneth J. Rabas, Waukesha, Wis.

[73] Assignee: DCI Marketing, Inc., Milwaukee, Wis.

[21] Appl. No.: 904,052

[22] Filed: Jul. 31, 1997

[51] Int. Cl.[6] ..... A47F 5/00

[52] U.S. Cl. ..... 211/59.3; 211/189; 211/175; 312/71

[58] Field of Search ..... 211/59.3, 59.2, 211/51, 189, 175, 184; 312/42, 71

[56] References Cited

U.S. PATENT DOCUMENTS 4,724,968 2/1988 Wombacher .

*Primary Examiner*—Robert W. Gibson, Jr.

*Attorney, Agent, or Firm*—Michael Best & Friedrich LLP

[57] ABSTRACT

A product display system which includes a basic unit including a track, a front wall, a back wall and a side member. The basic unit is easily assembled and disassembled. Two of more basic units can be ganged together to created customized displays to accommodate a wide varies of products of various sizes.

20 Claims, 8 Drawing Sheets

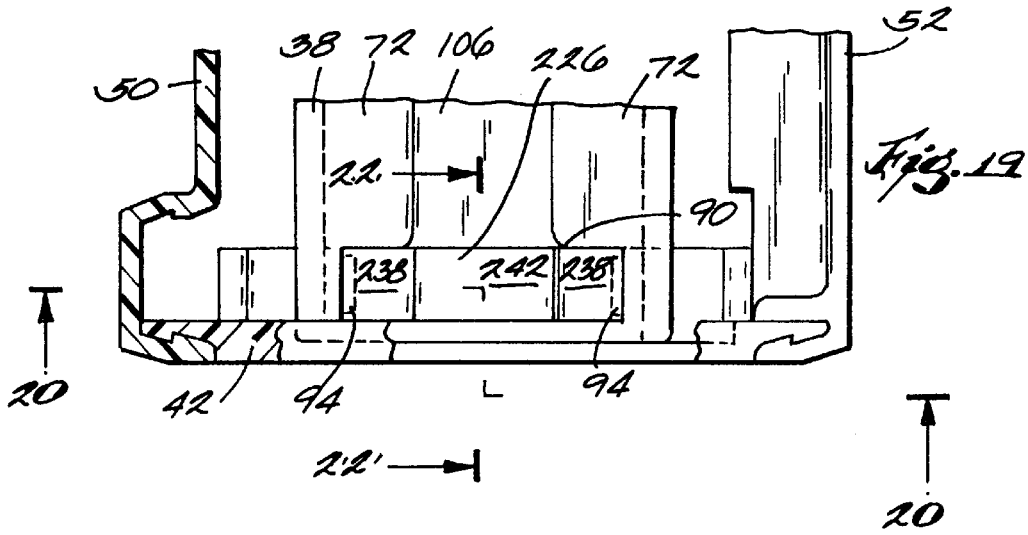
Fig. 19
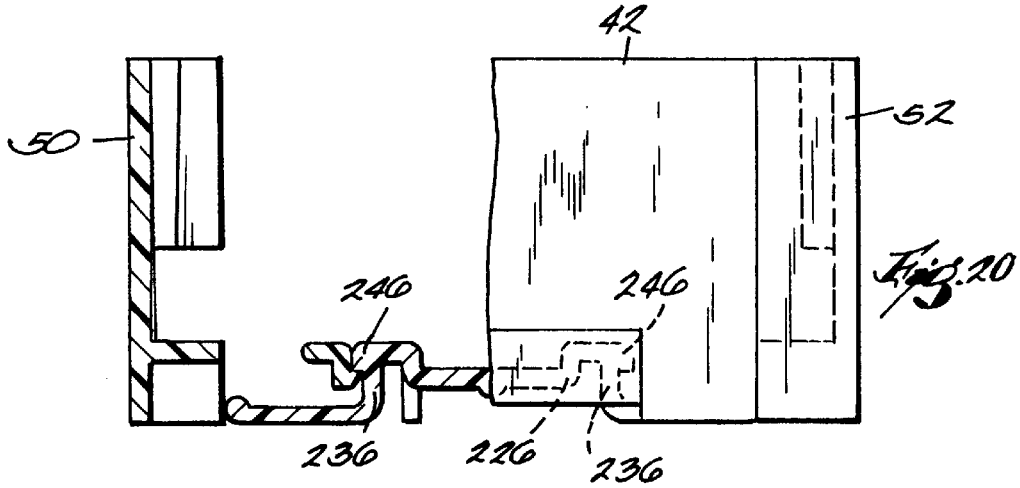
Fig. 20
Fig. 21
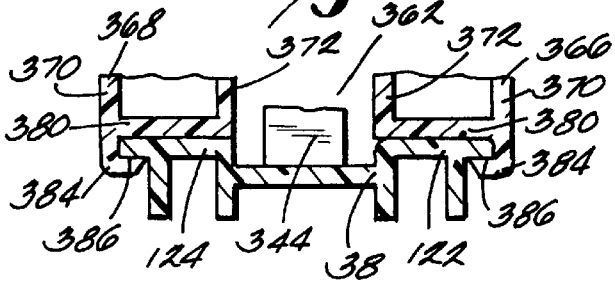
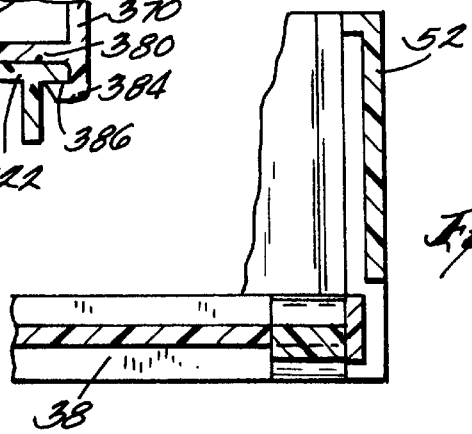
Fig. 22

PRODUCT DISPLAY SYSTEM

FIELD OF THE INVENTION

The invention relates to product display systems, and more particularly, to product display systems that are modular and easily adjustable.

BACKGROUND OF THE INVENTION

Product displays for use in retail establishments typically are designed to display products so that the products are easily visible and accessible to the consumer. A drawback to conventional product displays is that they do not provide easy access to the products. Another drawback in conventional displays is that either the displays cannot or do not easily accommodate different sized products. A retailer therefore has to purchase several different displays to display various sized products.

SUMMARY OF THE INVENTION

The invention provides product display for displaying products. The basic unit of the present invention includes a track having first and second outwardly extending projections, a back wall secured to the track, the back wall having first and second outwardly extending projections, a front wall secured to the track, the front wall having first and second outwardly extending projections and a side member defining a first channel having a shape complementary to the first projection of the front wall, a second channel having a shape complementary to the first projection of the back wall, and a recess. The side member is removably secured to the back wall by positioning the first projection of the back wall in the second channel, is removably secured to the front wall by positioning the first projection of the front wall in the first channel and is removably secured to the track by positioning the first projection of the track in the recess.

The present invention also provides for ganging of two or more basic units together through the use of dividers and low and high profile clips. Optionally, a biasing mechanism can be employed with the product displays to feed products toward the front of the displays.

It is an object of the present invention to provide an improved product display system.

It is another object of the present invention to provide a product display system that is modular.

It is another object of the present invention to provide a product display system that is easily adjustable.

It is another object of the present invention to provide a product display system that is easily adjustable to create a customized display area.

It is another object of the present invention to provide a product display system that is able to gang basic display units together.

It is another object of the present invention to provide a product display system that can accommodate different sized products.

It is another object of the present invention to provide a product display system that is easily disassembled.

Other features and advantages of the invention will become apparent to those of ordinary skill in the art upon review of the following detailed description, claims, and drawings.

BRIEF DESCRIPTION OF THE DRAWINGS

FIG. 19 is a partial sectional view of the side members and back wall secured to the track;

FIG. 20 is a view taken along line 20—20 of FIG. 19;

FIG. 21 is a sectional view of the track and a biasing mechanism;

FIG. 22 is a view taken along line 22—22 of FIG. 19;

FIG. 23 is a perspective view of an two basic unit ganged together; and

Figure 1:
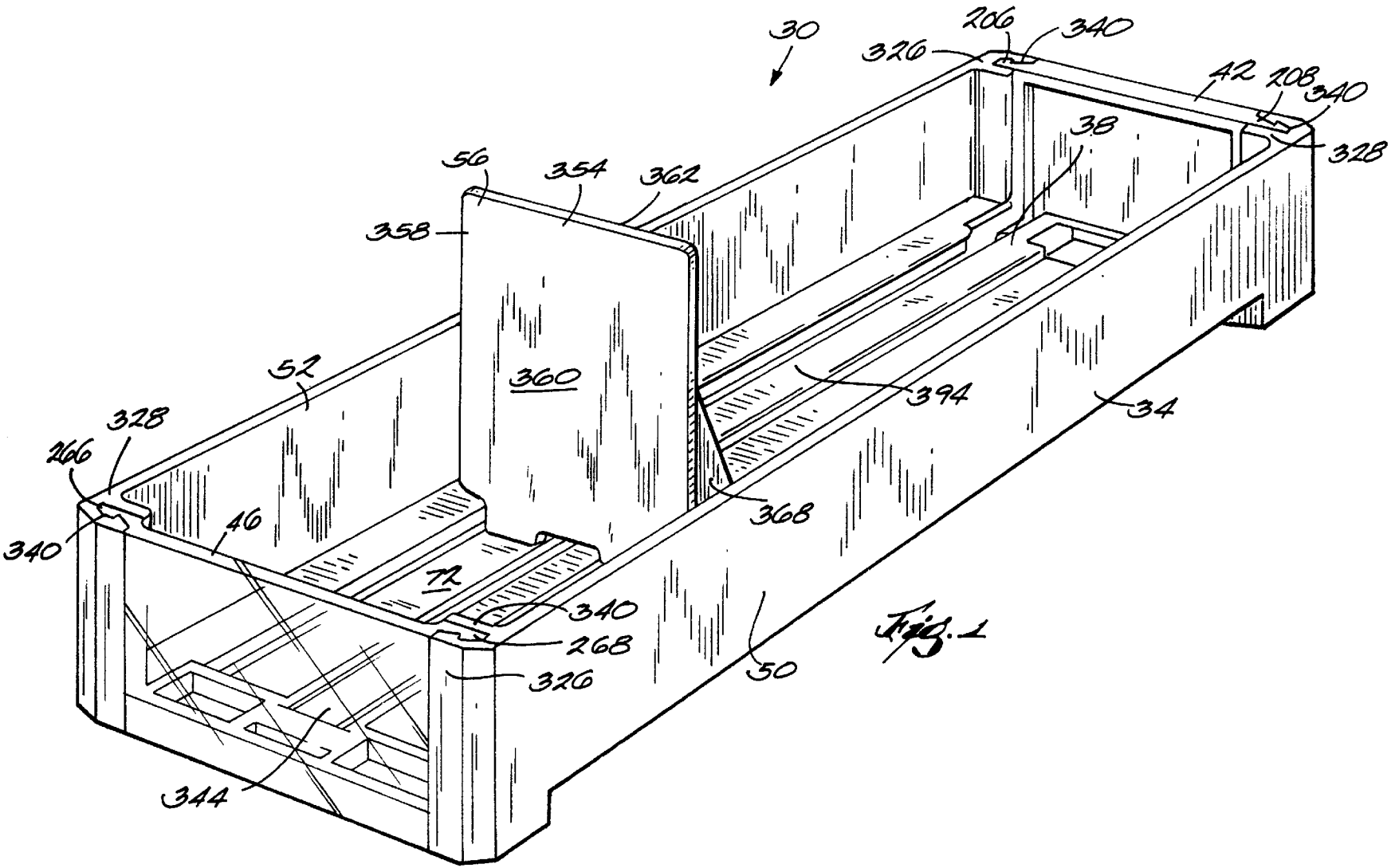
FIG. 1 is a perspective view of a basic unit embodying the invention with an additional side member and biasing mechanism.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings, there is shown in FIG. 1 a product display system 30 embodying the invention. The product display system 30 is comprised of many interconnecting parts that cooperate to form a customized product display system. A basic display unit 34 will be described first followed by a description of how the basic units can be ganged together to customize a display.

Continuing to refer to FIG. 1, the basic display unit 34 is comprised of a track 38, a back wall 42, a front wall 46, and a side wall 50. FIG. 1 also depicts a second side wall 52 and a biasing mechanism 56.

Figure 2:
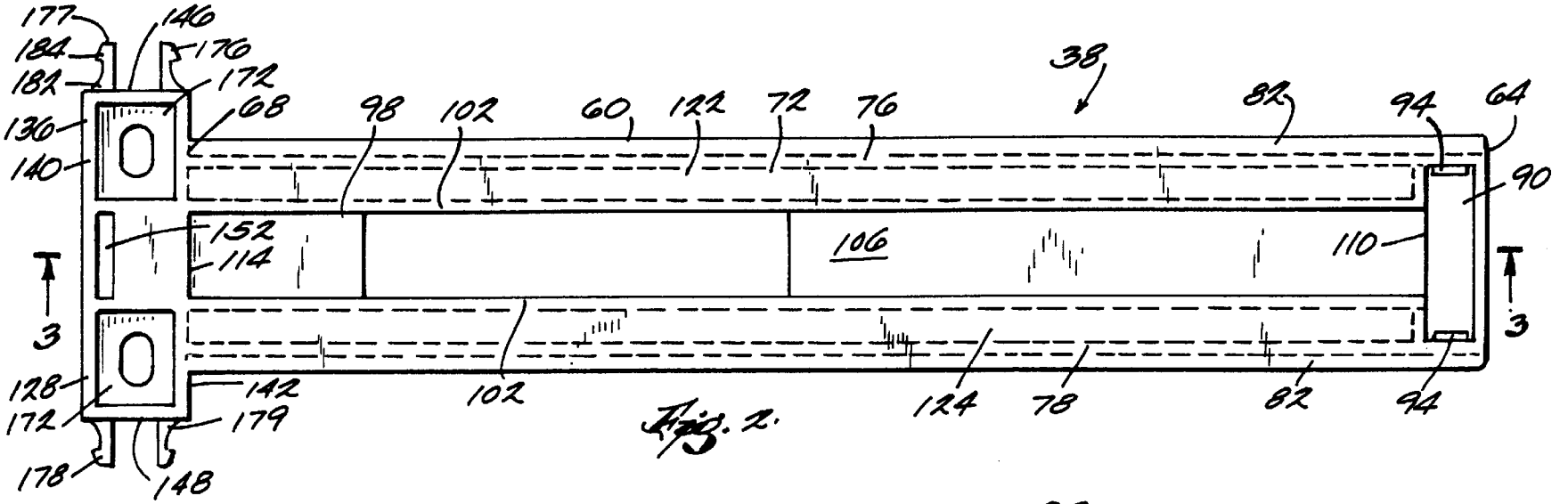
FIG. 2 is a plan view of a track.
Figure 3:
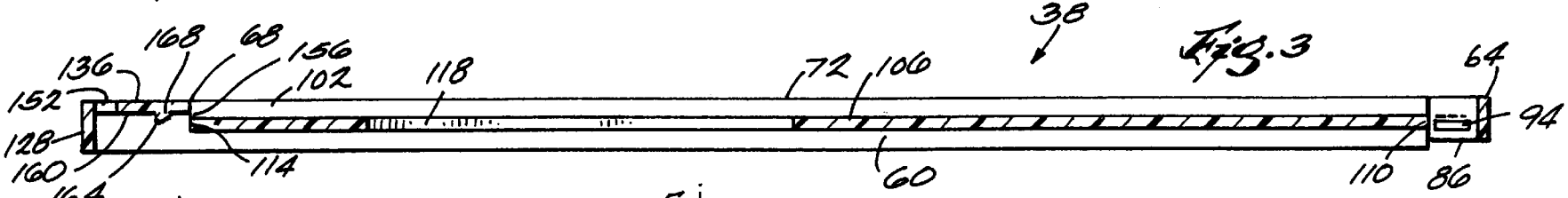
FIG. 3 is a view taken along line 3—3 of FIG. 2.

Specifically, and with reference to FIGS. 2 and 3, the track 38 includes an elongate portion 60 having a first end edge 64, a second end edge 68, a top wall 72 and a pair of spaced side walls 76 and 78. The side walls 74 depend from the top wall 72. The portions of the top wall 72 that extend outwardly of the side walls 76 and 78 define a lip 82. Each side wall 76 and 78 includes a relieved area 86 near the first end edge 64. The top wall 72 includes a rectangular aperture 90 adjacent the first end edge 64. A pair of generally rectangular ledges 94 extend into the aperture 90 with one ledge 94 extending outwardly from each of the side walls 76 and 78. A channel 98 is formed in the center of the elongate portion 60. The channel 98 is defined by a pair of side walls 102 and a bottom wall 106. The bottom wall 106 has a first end 110 and a second end 114. The first end 110 is in communication with the aperture 90. The bottom wall 106 includes an opening 118. The channel 98 divides the top wall 72 into a first guide portion 122 and a second guide portion 124.

The track 38 further includes an end portion 128 that abuts or preferably is integral with the second end edge 68 of the elongate portion 60. The end portion 128 includes a top wall 136, a pair of side walls 140 and 142 and a pair of end walls 146 and 148. The top wall 136 has therein a rectangular slot 152 near the side wall 140. The top wall 136 and the bottom wall 106 of the channel 98 of the elongate portion 60 cooperate to define a slot 156. The top wall 136 includes a bottom surface 160 from which depends a cylindrical projection 164 having a chamfered lower edge 168. A square recessed portion 172 is adjacent each end wall 146 and 148.

A pair of interlocking members or legs 176, 177, 178 and 179 extend outwardly from the respective end walls 146 and 148 in a direction away from the end portion 128. Each leg 176, 177, 178 and 179 includes a tapered portion 182 that terminates in a hook portion 184. Each leg 176, 177, 178 and 179 are configured so that the hook portions 184 extend outwardly from the tapered portion 182 in an opposed direction away from each other.

Figures 6, 7, 8, 9:
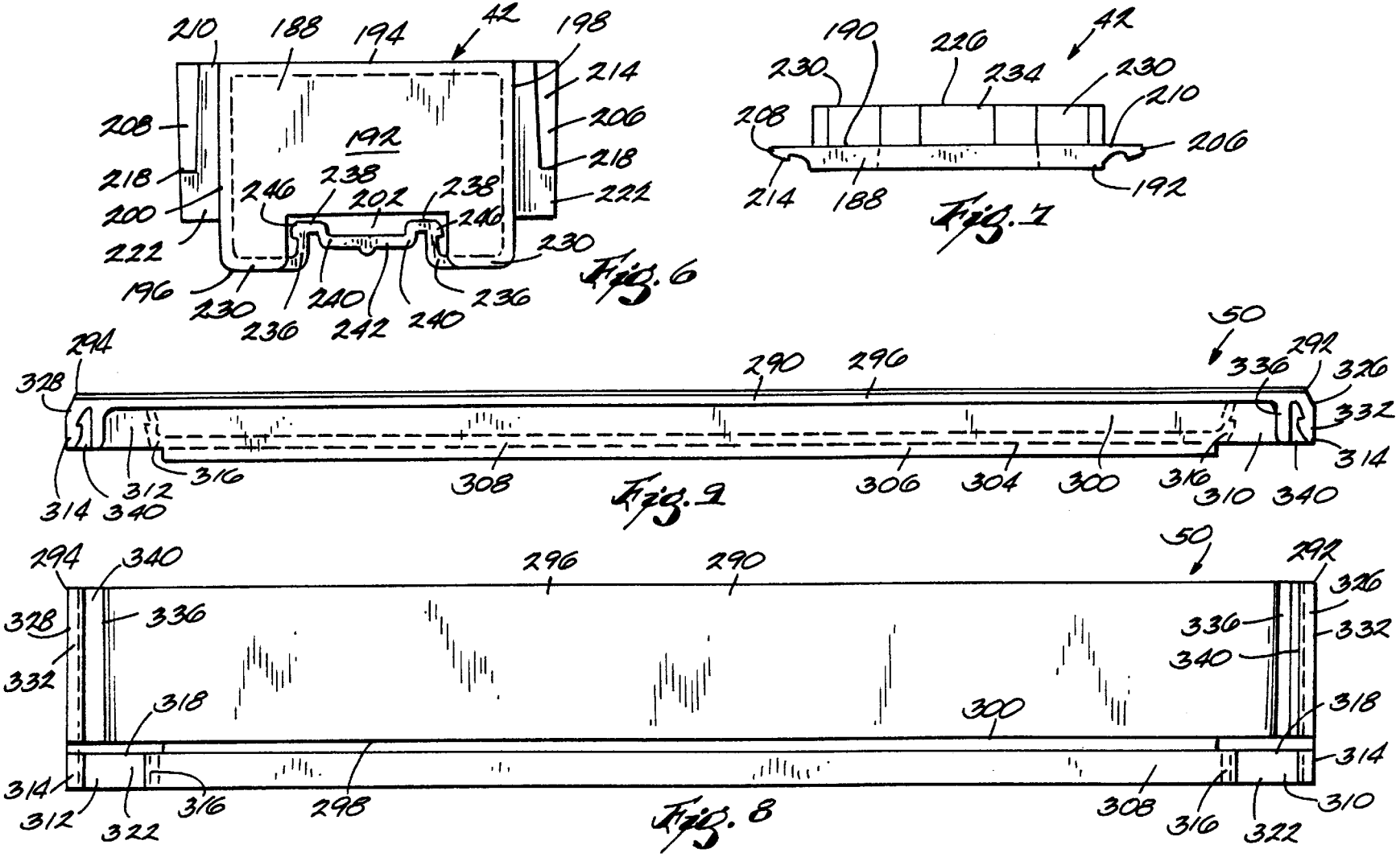
FIG. 6 is a front view of a back wall.
FIG. 7 is a plan view of the back wall.
FIG. 8 is a side view of a side wall.
FIG. 9 is a plan view of the side wall.

Referring now to FIGS. 6 and 7, there is shown in more detail the back wall 42. The back wall 42 includes a plate portion 188 having a front face 190, a back face 192, a top edge 194, a bottom edge 196 and a pair of side edges 198 and 200. The plate portion 188 includes a relieved area 202 adjacent the bottom edge 196.

Interlocking members or elongate legs 206 and 208 extend outwardly from the side edges 198 and 200 respectively. Legs 206 and 208 include a tapered portion 210 and an outwardly extending hook portion 214. Legs 206 and 208 terminate in a lower end 218. The legs 206 and 208 are elongate and extend approximately one-half the length of the respective side edges 198 and 200. Legs 206 and 208 are oriented such that the hook portions 214 extends outwardly in a direction away from the front face 190 of the plate portion 188. A planar elongate wall 222 depends from the lower end 218 of legs 206 and 208.

A connector 226 extends outwardly from the face 190 and is adjacent the bottom edge 196 and the relieved area 202 of the plate portion 188. The connector 226 includes two end members 230 and a center member 234 therebetween. The end members 230 extend outwardly from the bottom edge 196 of the plate portion 188 and are generally perpendicular to the plate portion 188. The center member 234 includes a first wall 236 that extends upwardly from each end portion 230, a second wall 238 that is perpendicular to each first wall 236, a third wall 240 that depends from each second wall 238 and a fourth wall 242 between the pair of third walls 240. A flange portion 246 of each second wall 238 extends outwardly past the respective first wall 236.

Figure 5:
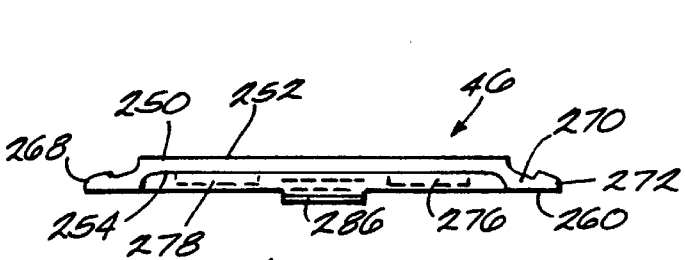
FIG. 5 is a view taken along line 5—5 of FIG. 4.
Figure 4:
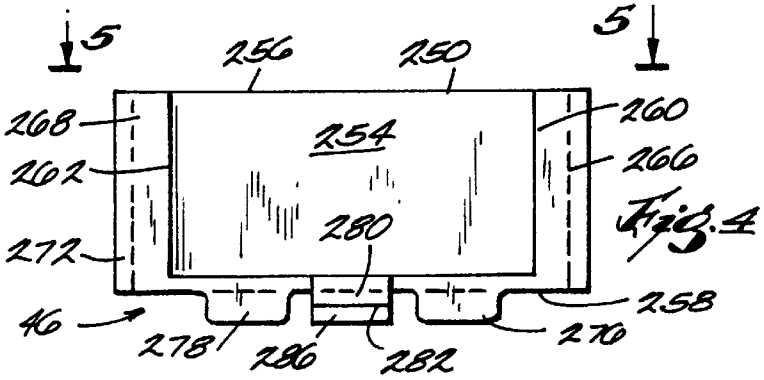
FIG. 4 is a front view of a front wall.

With reference to FIGS. 4 and 5, the front wall 46 includes a plate portion 250 having front face 252, a back face 254, a top edge 256, a bottom edge 258, a side edge 260 and a side edge 262. The front face 252 is available for the placement of product indicia such as product information, nutritional information, advertising or the like. Elongate legs 266 and 268 extend outwardly from the side edges 260 and 262 respectively. Each leg 266 and 268 include a tapered portion 270 and an outwardly extending hook portion 272. Each leg 266 and 268 are elongate and extend approximately the length of the respective side edges 260 or 262. The legs 266 and 268 are oriented such that the hook portions 272 extends outwardly and is on the front face 252 side of the plate portion 250.

Three projections 276, 278, and 280 depend from the bottom edge 258 of the plate portion 250. The first projection 276 is adjacent the side edge 260. The second projection 278 is adjacent the side edge 262. The third projection 280 is between the first projection 276 and the second projection 278. The third projection 280 has a lower edge 282 from which a hook 286 extends outwardly.

Referring now to FIGS. 8 and 9, the basic unit also includes the side wall 50. The side wall 50 includes a generally vertical elongate wall 290 having a pair of end edges 292 and 294, a top edge 296 and a bottom edge 298. A wall 300 extends outwardly from the bottom edge 298 of the wall 290 and is generally perpendicular to the wall 290. The wall 300 has an outer edge 304 that includes a lip 306 that extends outwardly from a portion of the wall 300. A wall 308 depends from a portion of the wall 300 so as to be generally parallel to the wall 290. A pair of connecters 310 and 312 depend from the wall 300 with one connector 310 or 312 adjacent each end of the wall 300. Each connector 310 and 312 includes a first arm 314, a second arm 316 and a web 318 therebetween. The arms 314 and 316, web 318 and wall 300 cooperate to define a recess 322. The arms 314 and 316 are configured such that the shape of the arms 314 and 316 are complementary to the legs 176, 177, 178 and 179 of the track 38 so that the legs 176 and 177 or the legs 178 and 179 and the respective arms 314 and 316 interengage in the recess 322 to prevent lateral movement of the side wall 50 relative to the track 38 as will be explained in more detail below.

Elongate connectors 326 and 328 are adjacent the end edges 292 and 294 respectively of the wall 290. Each connector 326 and 328 extends from the top edge 296 to the bottom edge 298 of the wall 290. Each connector 326 and 328 includes a pair of spaced walls 332 and 336 that extend outwardly from the wall 290 in the direction that the wall 300 extends outwardly from the wall 290. The walls 332 and 336 define therebetween a channel 340. The walls 332 and 336 of the channel 340 of connectors 326 and 328 are configured such that a cross-section of the channel 340 has a complementary configuration to the legs 206 or 208 of the back wall 42 thereby allowing the legs 206 or 208 to slide within the channel 340 and configured such that a cross-section of the channel 340 has a complementary configuration to the legs 266 or 268 of the front wall 46 thereby allowing the legs 266 or 268 to slide within the channel 340.

The side wall 52 as shown in FIG. 1 is preferably identical to the side wall 50.

Figure 17:
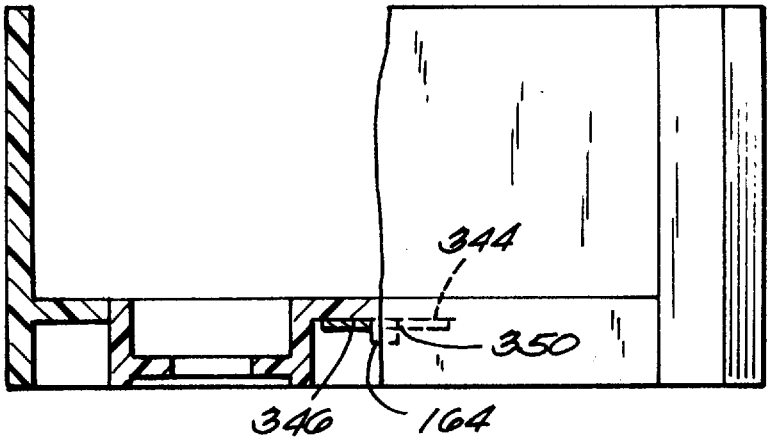
FIG. 17 is a view taken along line 17—17 of FIG. 16.

As shown in FIGS. 1 and 21, the biasing mechanism 56 includes a metal tape 344 molded to maintain a coil shape. The tape 344 includes a first end 346 having therein an aperture 350 (FIG. 17). The biasing mechanism 56 further includes a pusher 354 including a generally rectangular plate 358 having a front face 360 and a rear face 362 (FIG. 1). As best shown in FIG. 21, two generally triangular guides 366 and 368 extend outwardly from the rear face 362. Each guide 366 and 368 includes two triangular spaced, parallel walls 370 and 372. The walls 370 and 372 are positioned such that they abut the rear face 362 of the plate 358. A wall 380 connects the walls 370 and 372 of each guide 366 and 368. A sliding guide 384 depends from the wall 370 of each guide 366 and 368. The sliding guides 384 are generally L-shaped and cooperate with each wall 380 to form a channel 386.

Figure 18:
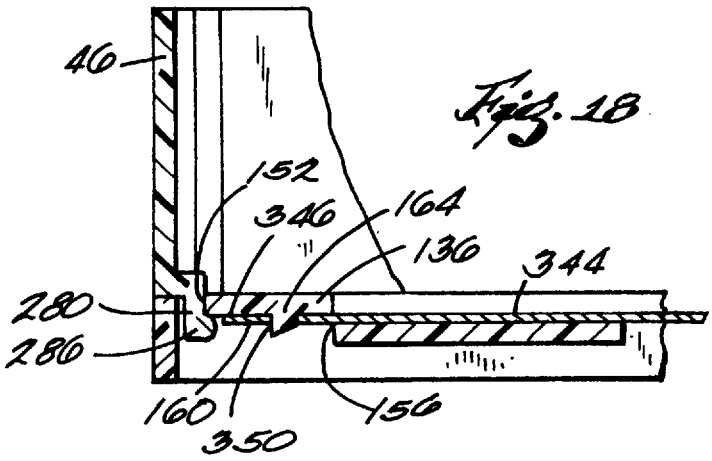
FIG. 18 is a view taken along line 18—18 of FIG. 16.
Figures 2, 3:
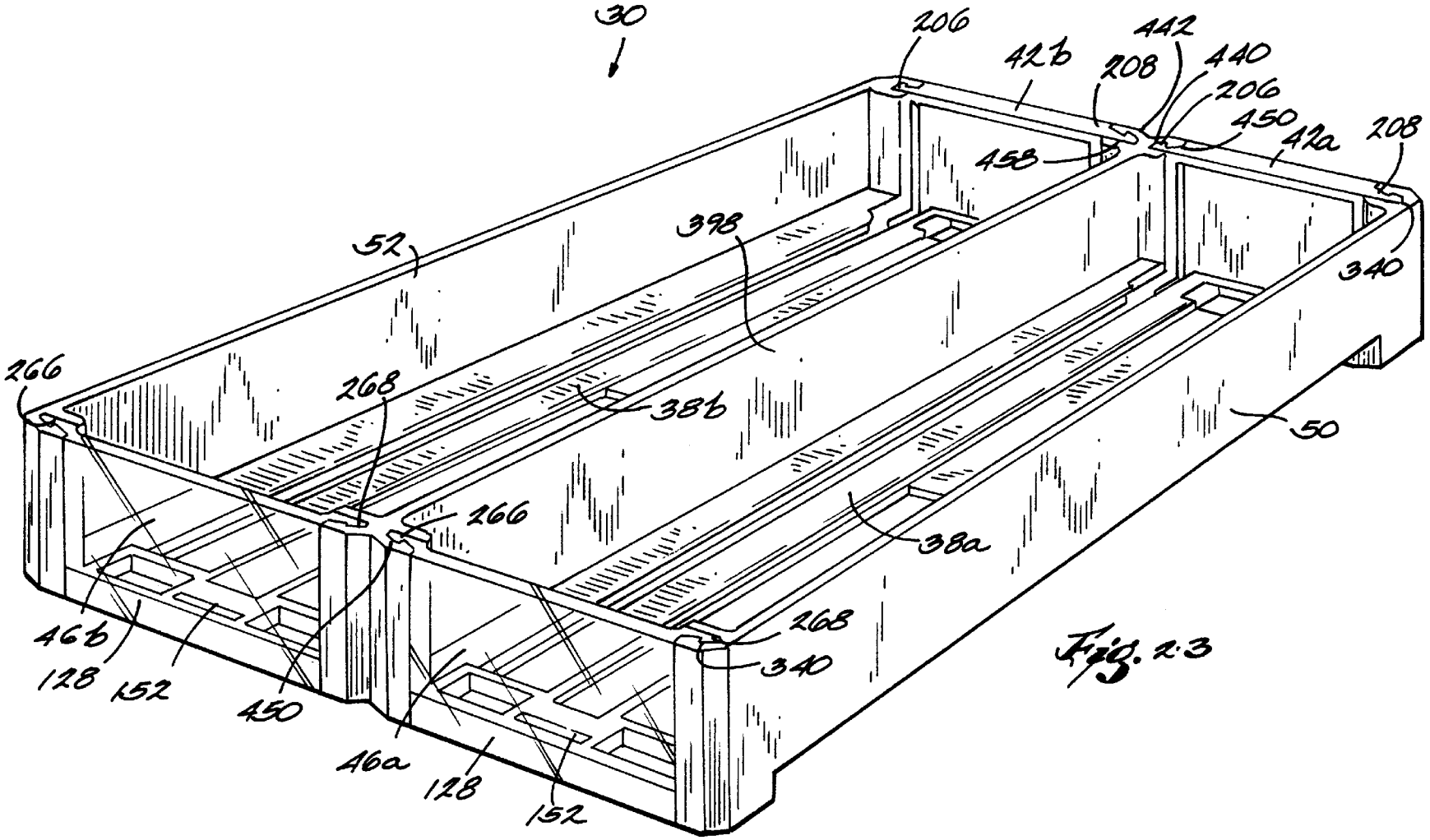

The basic unit is assembled as follows. The pusher 354 is assembled onto the track 38 as shown in FIG. 21. The coiled tape 344 is then positioned against the rear face 362 of the plate 358 between the two guides 366 and 368. As shown in FIG. 18, the end 346 of the tape 344 is threaded under the plate 358, through the slot 156 and then the aperture 350 is placed around the projection 164 that depends from the bottom surface 160 of the top wall 136 of the end position 128.

Referring now to FIGS. 19 and 20, the track 38 and back wall 42 are oriented such that the connector 226 of the back wall 42 is aligned with the aperture 90 of the top wall 72 of the track 38 from below. The back wall 42 is then raised such that the connector 226 is moved into the aperture 90. The ledges 94 that extend into the aperture 90 will initially prohibit further upward movement of the back wall 42. Sufficient upward force deflects the first walls 236 of the connector 226 slightly inwardly toward each other enabling the ledges 94 to slide along the flange portion 246 and secure the connector 226 in the aperture 90. In this orientation, the second walls 238 of the connector 226 are planar with the top wall 72 of the track 38, and the fourth wall 242 of the connector 226 is planar with bottom wall 106 of the channel 98 of the track 38.

With reference to FIG. 1, the side walls 50 and 52 are next assembled to the track 38 and the back wall 42. The side wall 50 is oriented such that the channel 340 of the connector 328 is aligned from below with the leg 208 of the back wall 42. The side wall 50 is then raised such that the leg 206 enter and slide in the complementary shaped channel 340. Relative motion of the side wall 50 and the back wall 42 terminates when the leg 208 contacts the wall 300 of the Side wall 50. Side wall 52 is similarly assembled such that the leg 206 of back wall 42 is slid in the complementary shaped channel 340 of connector 326 of side wall 52. The side walls 50 and 52 are then raised slightly and moved inwardly toward the track 38 and oriented as follows with respect to side wall 52 and FIG. 16. The recess 322 of the connector 312 of side wall 52 is aligned from above with the legs 176 and 177 of the end portion 128 of the track 38. The side wall 52 is then lowered such that the legs 176 and 177 are housed in the recess 322. The complementary shaped recess 322 and legs 176 and 177 prevent lateral movement of the side wall 52 relative to the track 38. The side wall 50 is similarly assembled to the track 38.

Figure 16:
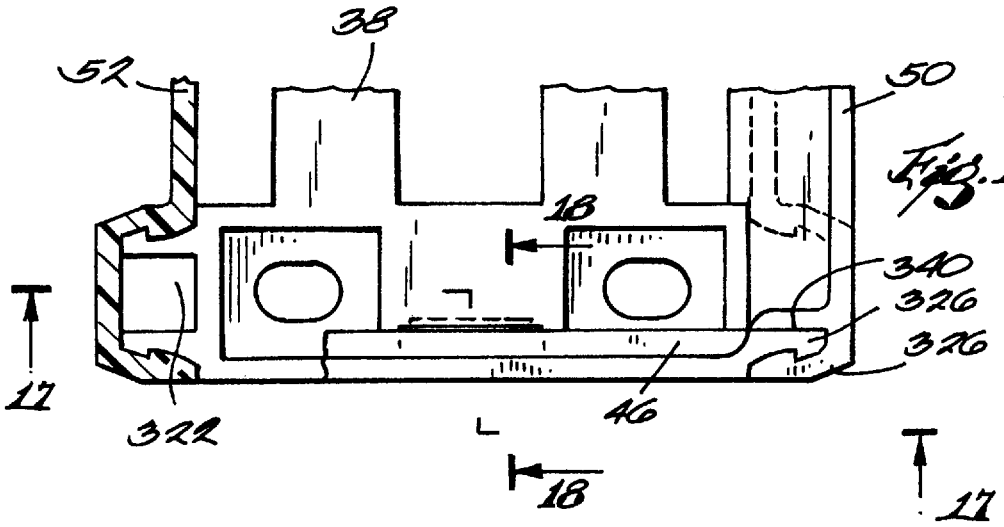
FIG. 16 is a partial sectional view of side members and front wall secured to the track.

The front wall 46 is assembled next with reference to FIGS. 1 and 16. The front wall 46 is oriented such that the leg 268 is aligned from above with the channel 340 of the connector 326 of the side wall 50 and similarly the leg 266 is aligned with the channel 340 of the connector 328 of the side wall 52. Downward movement of the front wall causes the legs 266 and 268 to enter the respective channels 340 and travel downwardly. The projections 276, 278 and 280 of the front wall 46 contact the end portion 128 of the track 38. Sufficient downward force causes the hook 286 of the third projection 280 to deform slightly allowing the hook 286 to travel into the slot 152 and hold the front wall 46 in this position via the hook 286 abutting the top wall 136. In this position, the first and second projections 276 and 278 respectively are housed in the square recessed portions 172.

When assembled as shown in FIG. 1, the basic unit with additional side wall 52 and biasing mechanism 56 defines a generally rectangular display area 394. Products can be loaded into the display area 394 between the front wall 46 and the front face 360 of the pusher 354. The biasing mechanism 56 biases products toward the front wall 46. When a product is removed by a consumer, the coiled tape 344 urges the pusher 354 forward sliding along the top wall 72 to contact any products in front of the pusher 354. Products are loaded onto the basic unit by urging the pusher 354 toward the back wall 42 and loading the products between the front wall 46 and the pusher 354.

The dimensions of the basic unit can be altered to accommodate various sized and quantities of products. The width of the end portion 128 of the track 38 as well as the width of the back wall 42 can be enlarged or shortened as necessary to accommodate difference sized products. Further, the track 38 and the side walls 50 and 52 can be lengthened or shortened to accommodate varying quantities of products.

The product display system 30 of the present invention also contemplates various other configurations involving permutations of the basic unit to accommodate different sized products and to accommodate the ganging of adjacent basic units together in an interlocking system.

The other components of the product display system 30 include a center divider 398, a low profile connector clip 400 and a high profile connector clip 402.

Figure 10:
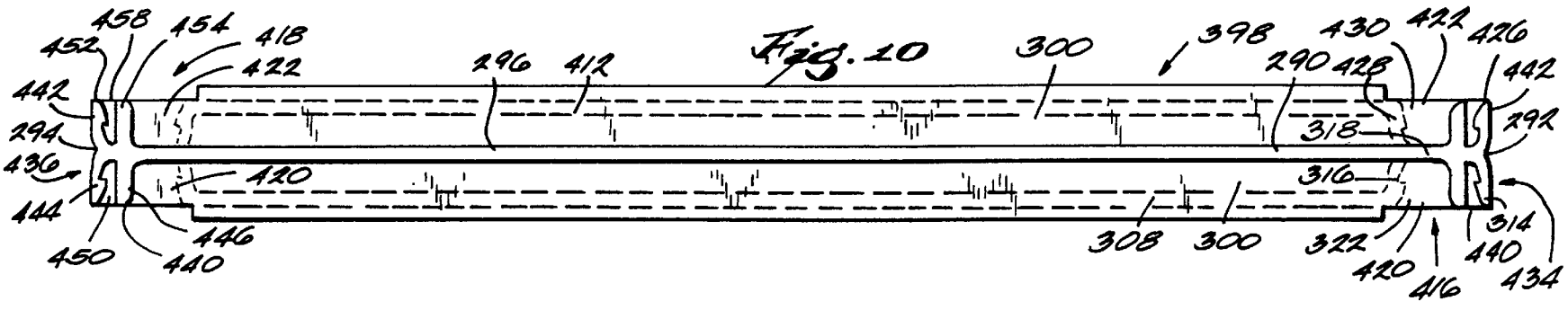
FIG. 10 is a plan view of a divider.
Figure 11:
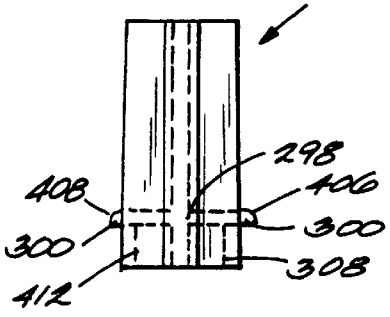
FIG. 11 is an end view of the divider.

As shown in FIGS. 10 and 11, the center divider 398 is similar to the side walls 50 and 52 and thereby like parts will be referred to with like reference numerals. The center divider 398 includes a generally vertical elongate wall 290 having a pair of end edges 292 and 294, a top edge 296 and a bottom edge 298. A wall 300 extends outwardly in both directions from the bottom edge 298 of the wall 290 in and is generally perpendicular to the wall 290. The wall 300 has a first outer edge 406 and a second outer edge 408. A wall 308 depends from the first outer edge 406 and a wall 412 depends from the second outer edge 408.

A pair of double connecters 416 and 418 depend from the wall 300 with connector 416 adjacent the end 292 of the wall 290 and connector 418 adjacent the end 294 of the wall 290. Each double connector 416 and 418 includes a first connector portion 420 and a second connector portion 422. The first connector portion 420 includes a first arm 314, a second arm 316 and a web 318 therebetween. The arms 314 and 316, the web 318 and wall 300 cooperate to define a first recess 322. The arms 314 and 316 are configured such that the shape of the first recess 322 is complementary to the legs 176, 177, 178, and 179 of the track 38 so that the legs 176 and 177 or the legs 178 and 179 and the arms 314 and 316 interengage to prevent lateral movement of the center divider 398 relative to the track 38. Similarly, the second connector portion 422 includes a first arm 426, a second arm 428 and the web 318 therebetween. The arms 426 and 428, the web 318 and wall 300 cooperate to define a second recess 430. The arms 416 and 428 are configured such that the shape of the second recess 430 is complementary to the legs 176, 177, 178 and 179 of the track 38 so that the legs 176 and 177 or the legs 178 and 179 and the arms 426 and 428 interengage to prevent lateral movement of the center divider 398 relative to the track 38.

Double elongate connectors 434 and 436 are adjacent the end edges 292 and 294 respectively of the wall 290. Each double connector 434 and 436 is comprised of a first connector portion 440 and a second connector portion 442. The first connector portion 440 is elongate and extends from the top edge 296 to the bottom edge 298 of the wall 290. The first connector portion 440 includes a pair of spaced walls 444 and 446 that extend outwardly from the wall 290 and define therebetween a channel 450. The walls 444 and 446 are configured such that a cross-section of the channel 450 has a complementary configuration to the legs 206 and 208 of the back wall 42 and the legs 266 and 268 of the front wall 46 thereby enabling the legs 206, 208, 266 or 268 to slide within the channel 450. The second connector portion 442 is elongate and extends from the top edge 296 to the bottom edge 298 of the wall 290. The second connector portion 442 includes a pair of spaced walls 452 and 454 that extend outwardly from the wall 290 and that define therebetween a channel 458. The walls 452 and 454 are configured such that a cross-section of the channel 458 has a complementary configuration to the legs 206 and 208 of the back wall and the legs 266 and 268 of the front wall 46 thereby enabling the legs 206, 208, 266 or 268 to slide within the channel 458.

Figure 12:
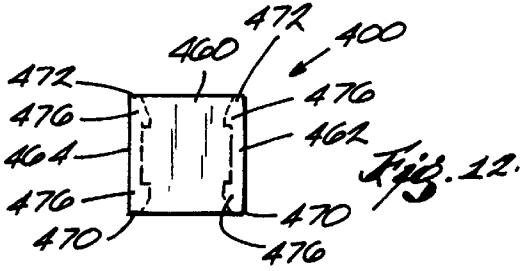
FIG. 12 is a plan view of a low profile clip.
Figure 13:
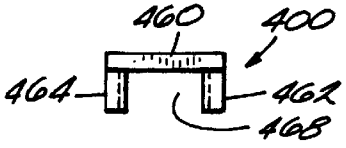
FIG. 13 is an end view of the low profile clip.

Referring to FIGS. 12 and 13, the low profile connector clip 400 is generally U-shaped and is comprised of a top wall 460 and two side walls 462 and 464 that depend from the top wall 460. The top wall 460 and the two side walls 462 and 462 cooperate to define a recess 468. The side walls 462 and 464 each have a first end 470 and a second end 472. A hook 476 extends into the recess 468 from each of the first and second ends 470 and 472 of each side wall 462 and 464.

Figure 14:
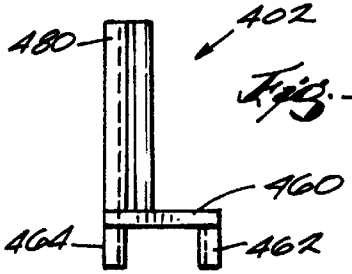
FIG. 14 is an end view of a high profile clip.
Figure 15:
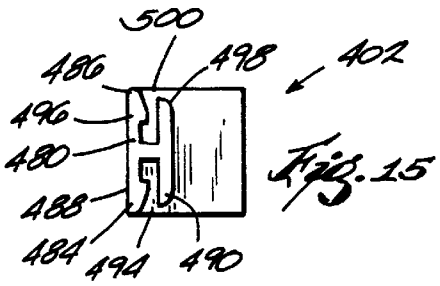
FIG. 15 is a bottom view of the high profile clip.

Referring now to FIGS. 14 and 15, the high profile connector clip 402 includes the structure of the low profile connector clip 400 with the addition of a double elongate connector 480. The double elongate connector 480 extends upwardly from the top wall 460 in a direction away from the side wall 462 and 464. The connector 480 is comprised of a first connector portion 484 and a second connector portion 486. The first connector portion 484 includes a pair of spaced walls 488 and 490 that defined therebetween a channel 494. The walls 488 and 490 are configured such that a cross-section of the channel 494 has a complementary configuration to the legs 206 and 208 of the back wall 42 and the legs 266 and 268 of the front wall 46. The second connector portion 486 includes a pair of spaced walls 496 and 498 that define therebetween a channel 500. The walls 496 and 498 are configured such that a cross-section of the channel 500 has a complementary configuration to the legs 206 and 208 of the back wall 42 and the legs 266 and 268 of the front wall 46.

The center divider 398, low profile connector clip 400 and high profile connector clip 402 are used with the components of the basic unit as follows.

If it is desired to gang basic units together in an adjacent manner, the product display system 30 is configured as follows and with reference to FIG. 23. Two tracks 38*a* and 38*b* with assembled back walls 42*a* and 42*b*. A center divider 398 is then positioned between the two tracks 38*a* and 38*b*. The leg 206 of the back wall 42*a* is slid into the channel 450 of the first connector portion 440 of the center divider 398. The leg 208 of the back wall 42*b* is slid into the channel 458 of the second connector portion 442 of the connector 434 of the center divider 398. The center divider 398 is then raised slightly and realigned such that the recess 322 of the connector 420 is lowered over the legs 176 and 177 of the track 38*a* and the recess 430 is lowered over the legs 178 and 179 of the track 38*b* thereby preventing lateral movement of the tracks 38*a* and 38*b* relative to the center divider 398. One side wall 50 is then secured to the track 38*a* and one side wall 52 is secured to the track 38*b* as described above. Two front walls 46*a* and 46*b* can then be positioned by placing the legs 266 and 268 of front wall 46*a* in the channels 450 and 340 respectively of the divider 398 and by placing the legs 266 and 268 of the front wall 46*b* in the channels 340 and 450 of the divider 398 respectively and then by securing the hooks 286 in the slots 152 respectively in each end portion 128 of the tracks 38*a* and 38*b*.

In this configuration, two basic units are ganged together in that they share a center divider 398. It should be noted that any number of basic units can be similarly ganged together with the use of an appropriate number of tracks 38, center dividers 398 and side walls 50 and 52.

Figure 24:
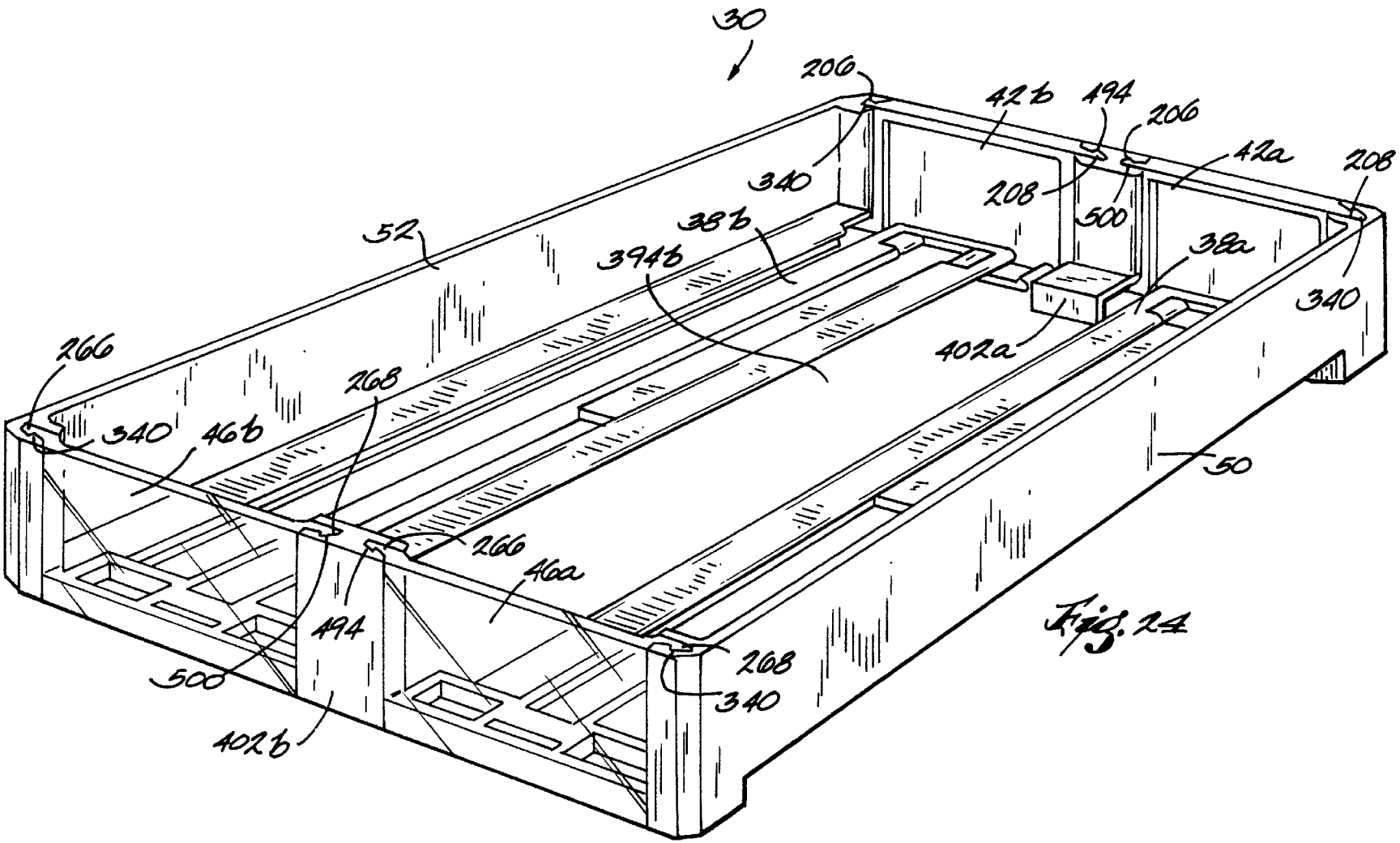
FIG. 24 is a perspective view of an alternate embodiment of two basic units ganged together.

In another configuration of the product display system 30 as shown in FIG. 24, two basic units are ganged together to form a larger display area 394*b* for the display of products that are wider than the width of one basic unit. In this configuration, two tracks 38*a* and 38*b* with assembled back walls 42*a* and 42*b* are laid out in a parallel orientation. One high profile connector clip 402*a* is utilized to secure the two back walls 42*a* and 42*b*. The leg 206 of the back wall 42*a* is positioned in the channel 500 of the clip 402*a* and the leg 208 of the other back wall 42*b* is positioned in the channel 494. A second high profile connector clip 402*b* is positioned over the legs 176 and 177 of the track 38*a* and the legs 178 and 179 of the track 38*b*. Side walls 50 and 52 can then be positioned as previously described at each side of the display by positioning of the legs 176 and 177 of the track 38*a* in the recess 312 of the side wall 50 and the leg 208 of the back wall 42*a* in the channel 340 of the side wall 50 and by similarly by positioning of the legs 178 and 179 of the track 38*b* in the recess 322 of the side wall 52 and the leg 206 of the back wall 42*b* in the channel 340 of the side wall 52. Two front walls 46*a* and 46*b* are then assembled by placing the leg 268 of the front wall 46*a* in the channel 340 of the side wall 50, the leg 266 of the front wall 46*a* in the channel 494 of the clip 402*b*, the leg 268 of the front wall 46*b* in the channel 500 of the clip 402*b* and the leg 266 of the front wall 46*b* in the channel 340 of the side wall 52. Wider products can then be accommodated in the display area 394*b* using this configuration.

It should be noted that a variation of the configuration of the product display system 30 as shown in FIG. 24 is in the use of a low profile connector clip 400 and a double sized front wall. Specifically, the system 30 is assembled as described above through the point of the high profile connector clip 402*a* securing the adjacent back walls 42*a* and 42*b*. In place of the high profile connector clip 402*b* securing the tracks 38*a* and 38*b* together at the front of the display, a low profile connector clip 400 is utilized by placing the clip 400 over the legs 176 and 177 of the track 38*a* and the legs 178 and 179 of the track 38*b* such that the hooks 476 of the clip 400 interengage with the hook portions 184 of the legs 176, 177, 178 and 179. The clip 400 thus secures the tracks 38*a* and 38*b* together by preventing lateral movement of the tracks 38*a* and 38*b* relative to the clip 400. The side walls 50 and 52 are then assembled as previously described. A double sized front wall can then be positioned such that the leg 268 is positioned in the channel 340 of the side wall 50 and other leg 266 is positioned in the channel 340 of the side wall 52.

The track 38, back wall 42, front wall 46, side walls 50 and 52, center divider 398, low profile connector clip 400 and high profile connector clip 402 are injection molded out of a plastic such as styrene. Preferably, for ease of manufacture and modularity, the legs 176, 177, 178 and 179 of the track 38, the legs 206 and 208 of the back wall 42 and the legs 266 and 268 of the front wall 46 are all identical in cross-section.

I claim:

1. A product display for displaying products comprising:

a track having a front end, a back end, a first side, a second side, a first projection extending outwardly from the first side and a second projection extending outwardly from the second side;

a back wall secured to the back end of the track, the back wall having a first side edge and a second side edge, a first elongate projection extends outwardly from the first side edge and a second elongate projection extends outwardly from the second side edge;

a front wall secured to the front end of the track, the front wall having a first side edge and a second side edge, a first elongate projection extends outwardly from the first side edge of the front wall and a second elongate projection extends outwardly from the second side edge of the front wall; and a side member including an elongate wall having a first and a second end, the first end defining a first channel having a shape complementary to the first elongate projection of the front wall and the second end defining a second channel having a shape complementary to the first elongate projection of the back wall, the second end having therein a recess, and the side member is removably secured to the back wall by positioning the first elongate projection of the back wall in the second channel, is removably secured to the front wall by positioning the first elongate projection of the front wall in the first channel and is removably secured to the track by positioning the first projection of the track in the recess.

2. A product display as set forth in claim 1 and further including a second side member including an elongate wall having a first and a second end, the second end defines a second channel having a shape complementary to the second elongate projection, and a second recess, the second side member is removably secured to the back wall by positioning the second elongate projection in the second channel and by positioning the second projection of the track in the second recess thereby preventing movement of the track and back wall relative to the second side member.

3. A product display as set forth in claim 2 wherein the side member and the second side member are identical.

4. A product display as set forth in claim 1 wherein the first and second projections of the track are identical.

5. A product display as set forth in claim 1 wherein the first and second projections of the track include a tapered portion and a hook portion.

6. A product display as set forth in claim 1 wherein the first and second elongate projections of the back wall are identical.

7. A product display as set forth in claim 1 wherein the first and second elongate projections of the back wall include a tapered portion and a hook portion.

8. A product display as set forth in claim 1 wherein the first and second elongate projections of the front wall are identical.

9. A product display as set forth in claim 1 wherein the first and second elongate projections of the front wall include a tapered portion and a hook portion.

10. A product display as set forth in claim 1 wherein the first and second elongate projections of the back wall and the first and second elongate projections of the front wall are identical in cross-section.

11. A product display as set forth in claim 1 and further including a biasing mechanism on the track for urging any displayed products toward the front wall.

12. A product display for displaying products comprising:

a first and second track, each track having a front end, a back end, a first side, a second side, a first projection extending outwardly from the first side and a second projection extending outwardly from the second side;

a first and second back wall, each back wall having a first side edge and a second side edge, a first projection extends outwardly from the first side edge and a second projection extends outwardly from the second side edge, the first back wall is secured to the first track and the second back wall is secured to the second track;

a first and second front wall, each front wall having a first side edge and a second side edge, a first projection extends outwardly from the first side edge of the front wall and a second projection extends outwardly from the second side edge of the front wall, the first front wall is secured to the first track and the second front wall is secured to the second track;

a side member including an elongate wall having a first and a second end, the first end defining a first channel having a shape complementary to the third projection of the first front wall and the second end defining a second channel having a shape complementary to first projection of the first back wall, the first end of the side member having therein a recess; and a divider having a first end and a second end, the first end defining a first channel having a shape complementary to the second projection of the first front wall, defining a second channel having a shape complementary to the first projection of the second front wall and defining a first recess, the second end defining a third channel having a shape complementary to the second projection of the first back wall and defining a fourth channel having a shape complementary to the first projection of the second back wall;

wherein the first projection of the first front wall is housed in the first channel of the side member, the first projection of the first back wall is housed in the second channel of the side member, the first projection of the first track is housed in the recess of the side member, the second projection of the first front wall is housed in the first channel of the divider, the second projection of the first back wall is housed in the third channel of the divider, the second projection of the first track is housed in the first recess of the divider, the first projection of the second front wall is housed in the second channel of the divider, the first projection of the second track is housed in the second recess of the divider, and the first projection of the second back wall is housed in the fourth channel of the divider.

13. A product display as set forth in claim 12 wherein the first and second channels of the side member and the first, second, third and fourth channels of the divider are identical in cross-section.

14. A product display as set forth in claim 12 wherein the first and second projections of the first and second front wall and the first and second projections of the first and second back walls are identical in cross-section.

15. A product display as set forth in claim 12 a further including a second side member including an elongate wall having a first and a second end, the first end of the second side member defining a first channel having a shape complementary to the second projection of the second front wall and the second end of the second side member defining a second channel having a shape complementary to second projection of the second back wall, the first end of the second side member having therein a recess, wherein the second projection of the second front wall is housed in the first channel of the second side member, the second projection of the second track is housed in the recess of the second side member, and the second projection of the second back wall is housed in the second channel of the second back wall.

16. A product display as set forth in claim 12 and further including a biasing mechanism on each of the first and second tracks to urge any displayed products toward the first and second front walls.

17. A product display for displaying products comprising:

a first and second track, each track having a front end, a back end, a first side, a second side, a first projection extending outwardly from the first side and a second projection extending outwardly from the second side;

a first and second back wall, each back wall having a first side edge and a second side edge, a first projection extends outwardly from the first side edge and a second projection extends outwardly from the second side edge, the first back wall is secured to the first track and the second back wall is secured to the second track;

a first and second front wall, each front wall having a first side edge and a second side edge, a first projection extends outwardly from the first side edge of the front wall and a second projection extends outwardly from the second side edge of the front wall, the first front wall is secured to the first track and the second front wall is secured to the second track;

a side member including an elongate wall having a first and a second end, the first end defining a first channel having a shape complementary to the third projection of the first front wall and the second end defining a second channel having a shape complementary to first projection of the first back wall, the first end of the side member having therein a recess; and a first and second connector clip, each connector clip defining a first channel, a second channel, a first recess and a second recess;

wherein the first projection of the first front wall is housed in the first channel of the side member, the first projection of the first back wall is housed in the second channel of the side member, the first projection of the first track is housed in the recess of the side member, the second projection of the first front wall is housed in the first channel of the first connector clip, the second projection of the first back wall is housed in the first channel of the second connector clip, the second projection of the first track is housed in the first recess of the first connector clip, the first projection of the second front wall is housed in the second channel of the first connector clip, the first projection of the second track is housed in the second recess of the first connector clip, and the first projection of the second back wall is housed in the second channel of the second connector clip.

18. A product display as set forth in claim 17 and further including a second side member including an elongate wall having a first and a second end, the first end of the second side member defining a first channel and a recess, the second end of the second side member defining a second channel, wherein the second projection of the second front wall is housed in the first channel of the second side member, the second projection of the second track is housed in the recess of the second side member, and the second projection of the second back wall is housed in the second channel of the second back wall.

19. A product display as set forth in claim 17 wherein first and second channels of the side member and the first and second channels of each of the connector clips are identical in cross-section.

20. A product display as set forth in claim 17 wherein the first and second projections of the first and second front walls and the first and second projections of the first and second back wall are identical in cross-section.

* * * * *